US005134728A

United States Patent [19]

Sturm

[11] Patent Number: 5,134,728

[45] Date of Patent: Aug. 4, 1992

[54] ADJUSTABLE HEIGHT URINAL

[76] Inventor: Russell J. Sturm, 5308 Coronado Dr., Raleigh, N.C. 27609

[21] Appl. No.: 616,391

[22] Filed: Nov. 21, 1990

[51] Int. Cl.[5] ..... E03D 13/00

[52] U.S. Cl. ..... 4/307; 4/312; 4/341

[58] Field of Search ..... 4/307, 312, 340, 341, 4/DIG. 2, 342

[56] References Cited

U.S. PATENT DOCUMENTS 4,726,079 2/1988 Signori et al. ..... 4/DIG. 2 X 4,982,455 1/1991 Carter ..... 4/307

FOREIGN PATENT DOCUMENTS 2839242 3/1980 Fed. Rep. of Germany ..... 4/307

*Primary Examiner*—Charles E. Phillips

*Attorney, Agent, or Firm*—Rosenthal & Putterman

[57] ABSTRACT

A height adjustable urinal is disclosed. The urinal receptacle is mounted on a slide plate that is connected to a hydraulic cylinder. Water is directed under pressure into and out of the hydraulic cylinder to adjust the receptacle to the desired height.

5 Claims, 3 Drawing Sheets

ADJUSTABLE HEIGHT URINAL

FIELD OF THE INVENTION

This invention relates generally to the field of urinals and more specifically, to urinals which are adjustable in height and movable to be stored within a cabinet when not in use.

BACKGROUND OF THE INVENTION

Urinals, per se, are well known. They are wall mounted in restrooms for use by male patrons. However, while widespread in use, they are not without their drawbacks. For example, they can be inaccessible to handicapped persons such as those that are confined to wheelchairs and to the infirmed confined to a bed or hospital room where ambulating to a conventional bathroom would be difficult. In addition, most bathrooms, while they may contain a number of urinals, they are all mounted at a uniform height above the floor. This can make using the urinal difficult for children or tall adults. In addition to being unsightly, substantial amounts of water are required to flush the urinal which is undesirable in areas having water shortages or where the supply is otherwise limited such as on airplanes, buses, campers, etc.

In view of the foregoing, it is an object of the present invention to provide a urinal that is adjustable in height and is thus, universally accessible.

Another object is to provide a urinal that conserves water when flushed.

Yet another object is to provide a urinal that is stored away from view within a cabinet when not in use.

Still another object is to provide a portable urinal that could be positioned adjacent a bed such as in a hospital or nursing home for use by patients.

SUMMARY OF THE INVENTION

These and other object of the present invention are accomplished by an adjustable height urinal that includes a receptacle having a water inlet end and a water outlet end. A hydraulic cylinder for adjusting the height of the receptacle is provided and is operatively associated with the receptacle. The hydraulic cylinder includes a water inlet. A height adjustment valve includes an inlet side connected to a water supply and an outlet side connected to the water inlet of the hydraulic cylinder. The height adjustment valve is movable between an operative position and an inoperative position. A flush valve having a second inlet side and a second outlet side is provided. The second inlet side communicates with the water inlet side of the hydraulic cylinder and the second outlet side communicates with the water inlet end of the receptacle. The flush valve is movable between a filling position and an emptying position.

When the height adjustment valve is in the operative position and the flush valve is in the filling position, water is directed into the hydraulic cylinder and the receptacle is elevated. Furthermore, when the height adjustment valve is moved to the inoperative position and the flush valve is in the emptying position, water is drained from the hydraulic cylinder and is directed into the water inlet end of the receptacle to thereby flush the receptacle.

BRIEF DESCRIPTION OF THE DRAWINGS

Some of the features and advantages of the invention having been briefly stated, others will appear from the detailed specification which follows, when taken in connection with the accompanying drawings, in which.

DETAILED DESCRIPTION OF THE ILLUSTRATED EMBODIMENT

Figure 1:
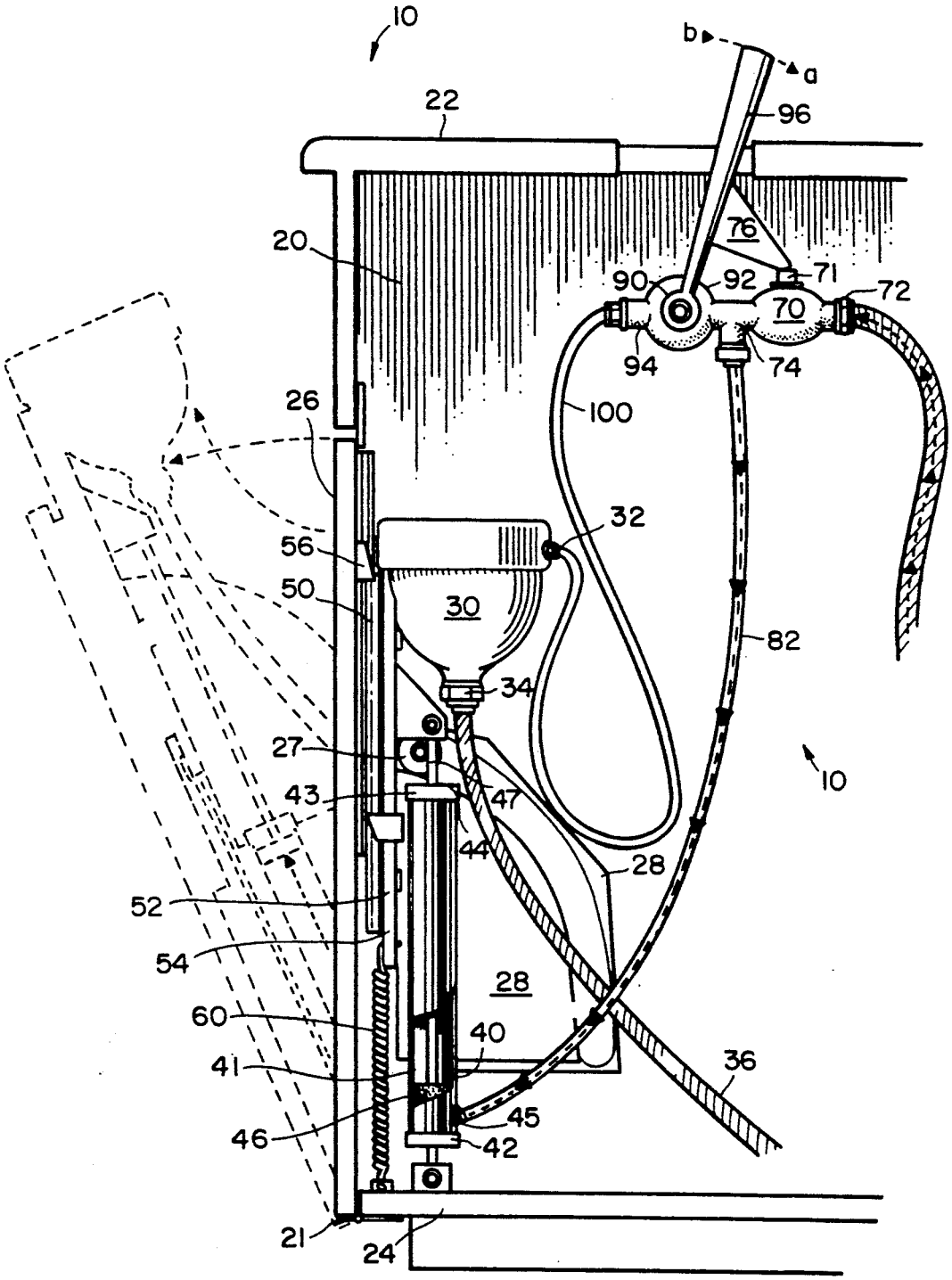
FIG. 1 is a side view of the urinal according to the present invention mounted within a cabinet and being moved from the inoperative position (solid lines) to the inoperative position (dotted lines).

While the present invention will be described more fully hereinafter with reference to the accompanying drawings, in which a particular embodiment is shown, it is to be understood at the outset that persons skilled in the art may modify the invention herein described while still achieving the favorable results of this invention. Accordingly, the description which follows is to be understood as a broad teaching disclosure directed to persons of skill in the appropriate arts and not as limiting upon the present invention.

It will be understood at the outset, that the urinal is suitable for installation in any type restroom, such as in public places, boats, trains, homes, business, etc. Furthermore, although the urinal is shown as being contained within an enclosure, this is merely for the sake of aesthetics, and could easily be mounted directly to a wall for either pure vertical movement or angular movement away from the wall for use without the need for any significant modification.

Referring now specifically to the drawings, the urinal of the present invention is generally indicated at 10 and is illustrated as being mounted within a cabinet 20. The cabinet 20 includes a top portion 22, a bottom portion 24, opposite side panels 25, and a front panel 26. The front panel 26 is connected to the bottom portion 24 by means of a conventional hinge 21. A roller mechanism 27 is affixed to the inside of side panel 25. In addition, a cam 28 is perpendicularly connected to the interior of front panel 26 proximate the lower half thereof.

The urinal 10 includes a receptacle 30 generally in the form of a funnel being wider at its upper end and tapering to a point at its lower end. The receptacle includes a water inlet 32 located near the upper end and a waste outlet 34 located at the lower end to which a drainage hose 36 is connected.

A hydraulic cylinder 40 is operatively associated with receptacle 30 for adjusting the height thereof. The hydraulic cylinder 40 is of conventional construction comprising a hollow cylindrical casing 41 with a bottom end cap 42 and a top end cap 43. A hole defining opening 44. Also, cylindrical casing 41 includes a water inlet 45 located proximate the bottom end of the cylinder 40. A piston 46 and rod 47 assembly is positioned for reciprocating movement within cylindrical casing 41. One end of the rod 47 is connected to the piston 46 and the other end extends through opening 44 and is connected with a bolt 46 and nut 47 to a slide plate 50 as will be explained in greater detail hereinbelow. Similarly, the opposite or lower end of the hydraulic cylinder is connected with a bolt 48 and nut 49 to the bottom portion 24 of cabinet 20.

Figure 3:
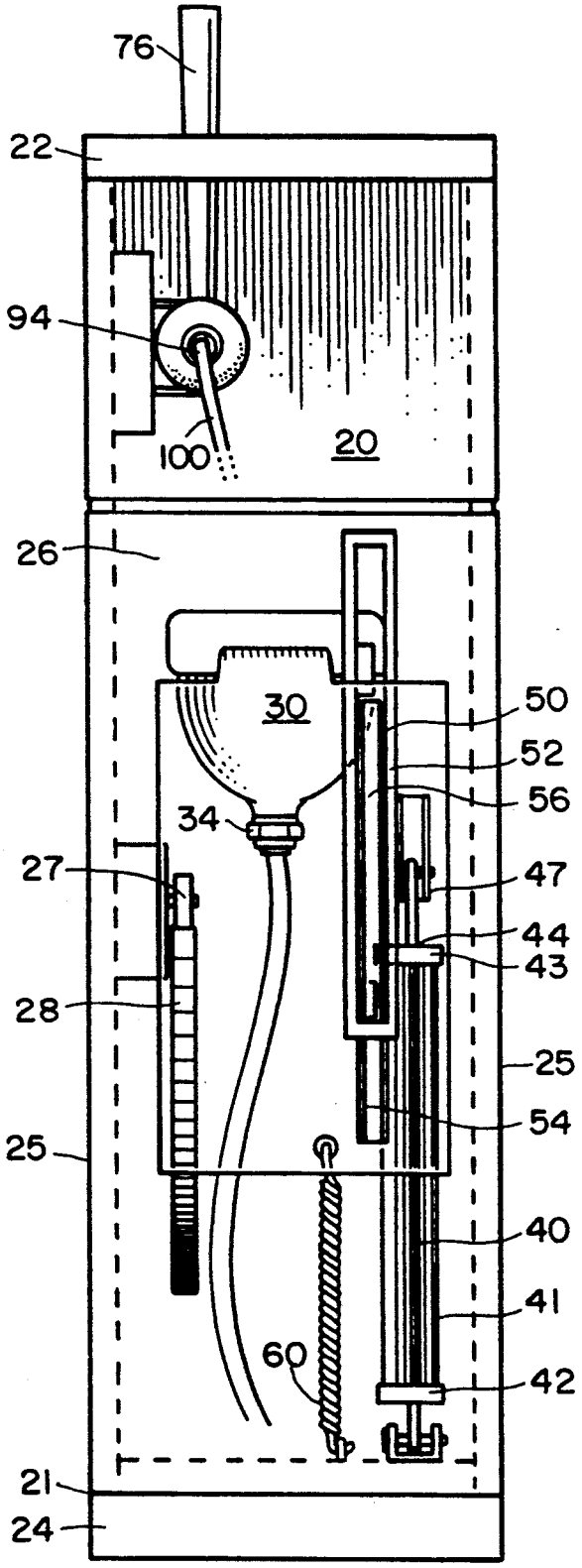
FIG. 3 is a front view of the urinal of the present invention mounted within a cabinet in the inoperative position.

The slide plate 50 comprises an elongate rectangular frame member 52 that is mounted vertically on the inner side of front panel 26 by conventional means (not shown) and a slide member 54 mounted for vertical movement therein (as best illustrated in FIG. 3). The slide member 54 includes an upper end 56. The side of the receptacle or urinal bowl 30 opposite the water inlet 32 is connected to the upper end 56 of the slide member 54 by means such as screws, etc., not shown. Similarly, a spring means or spring 60 has one of its ends connected to the lower end of slide member 54 and its other end is connected to the bottom portion 24 of the cabinet 20. The spring 60 has a spring constant such that the spring exerts a downward force less than the upward force exerted on the receptacle by the hydraulic cylinder when the height adjustment valve is in the operative position for permitting upward movement of the receptacle.

In an alternative embodiment (not shown) the water piston is provided with an outlet proximate the top end cup 42. Connected to the outlet is a gas piston (or pressure accumulater) which is employed as spring means 60. More specifically, when the piston is raised, the pressure in the gas piston increases. This pressure is later used to return the piston to its original position thereby returning the urinal to the inoperative position.

A height adjustment valve 70, such as a conventional spring loaded valve (which is spring loaded closed), is provided having an inlet side 72 and an outlet side 74 and a control lever 76. The inlet side 72 is connected to the water supply such as a conventional residential water system that is supplied in pipe or hose 80.

The outlet side 74 forms a "T" connection, one branch of which communicates with the water inlet 45 of hydraulic cylinder 40 by means of a line or hose 82, and the other end of which is connected to a flush valve 90, described in detail below. Control lever 76 is movable between an operative position wherein water flows through the valve and an inoperative position wherein the flow of water is interrupted.

The flush valve 90 includes a second inlet side 92 and a second outlet side 94 and a second control or flush valve lever 96 which is connected to lever 76. As previously mentioned, the second inlet side 42 is connected to the "T" connection and communicates via hose 82 with hydraulic cylinder 40 as well as the outlet side 74 of height adjustment valve 70. The second outlet side 94 communicates with the water inlet end 32 of receptacle 30 by means of hose 100 connected therebetween. The control lever 96 is movable between a filling position permitting water to flow through the valve and an emptying position wherein the flow of water through the valve is interrupted.

It will be understood that all plumbing connections described supra are of conventional construction, well known to those skilled in the art and, therefore, a detailed discussion of materials, connections, etc. is not deemed necessary. However, it will be noted that since this urinal is height adjustable, that all hoses required will preferably be flexible and, therefore, made of flexible plastic or rubber as opposed to PVC or copper piping as is also commonly used.

The urinal, when not in use, is stored completely within cabinet 20 as shown by the solid lines in FIG. 1. In the storage mode, the control lever 76 is in the inoperative position (as per FIG. 1) and water supply to the urinal is interrupted. Similarly, the flush valve 90 will likely have its lever in the emptying position (b) from the previous use.

Figure 2:
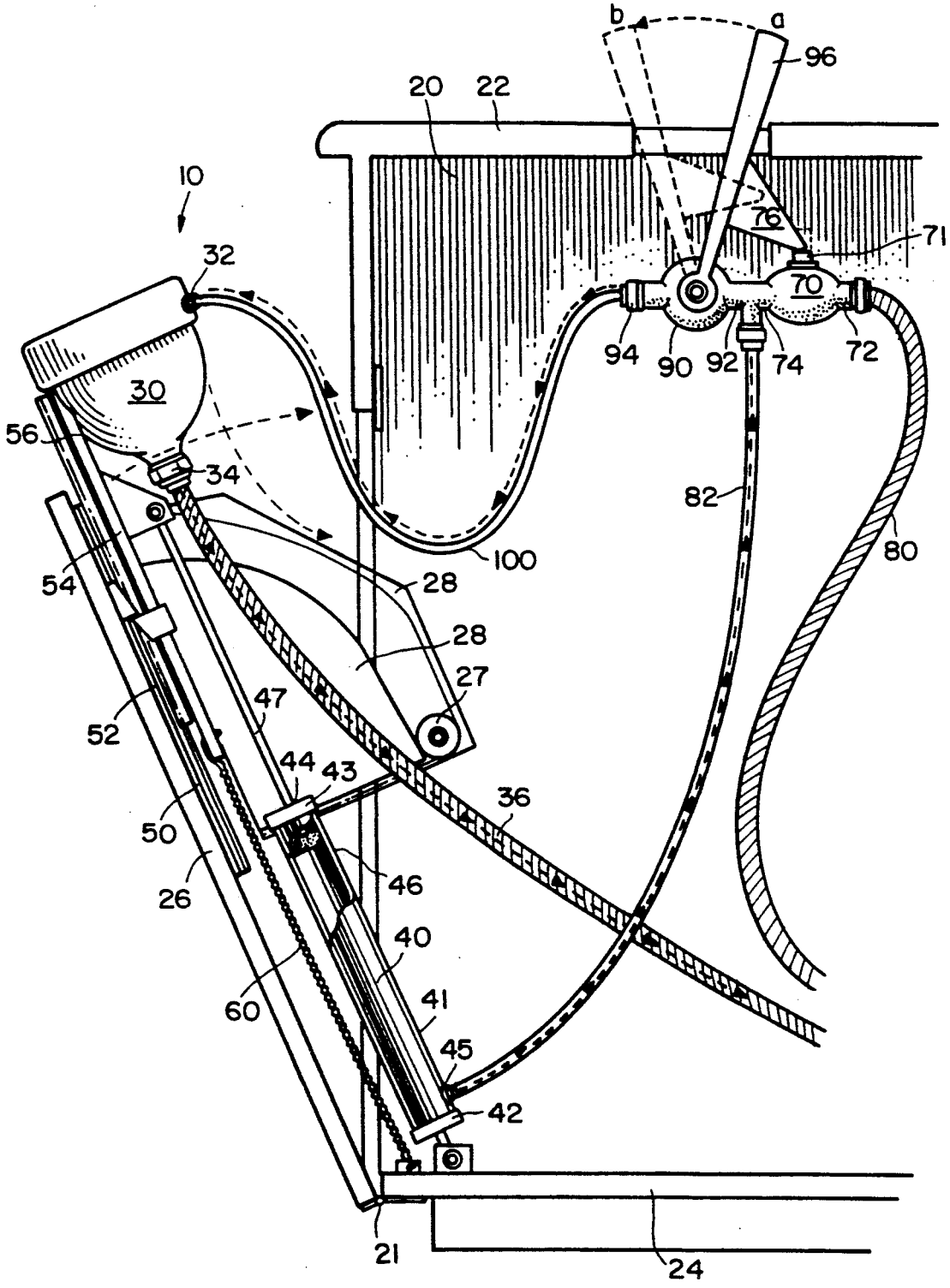
FIG. 2 is a side view of the urinal of the present invention mounted within a cabinet in the operative position being flushed and moving to the inoperative position.

When it is desired to expose the urinal for use, the flush valve lever 96 is moved to the filling position (a) an the height adjustment valve lever 76 is moved to the operative position (shown by the dashed lines in FIG. 2) depressing actuator 71. This enables water from the supply source in hose 80 to flow through the valve 70 and into hydraulic cylinder 40 via line 82. The water flowing under pressure into hydraulic cylinder 40 imparts an upward force on piston 46 and rod 47, which in turn elevates the receptacle 30 and elongates spring 60, thus placing it under tension. The movement of the rod 47 also causes the cam 28 to contact roller 27 to open the front panel 26 moving the receptacle outward and upward and presenting the receptacle for use. When the receptacle has reached the desired height, the lever 76 is released (i.e., to the returned inoperative position) closing valve 70 to stop the flow of water from the water source.

When it is desired to return the urinal for storage within cabinet 20, flush valve lever 96 is moved to the emptying position (b) which permits the free flow of water out of the hydraulic cylinder 40, into line 82, through flush valve 90 and into the bowl portion of receptacle via line 100 flushing the receptacle 30 and exiting through the water outlet thereof. Spring 60 pulls the piston 46 downward, automatically retracting the receptacle 30 and closing front panel 26.

The foregoing embodiments and examples are to be considered illustrative, rather than restrictive of the invention, and those modifications which come within the meaning and range of equivalence of the claims are to be included therein.

That which is claimed is:

1. An adjustable height urinal comprising:

a receptacle having a water inlet end and a waste outlet end below said inlet end;

a hydraulic cylinder for adjusting the height of said receptacle operatively associated with said receptacle and including a water inlet, said receptacle being height adjustable and stoppable at any position along the path of travel of said hydraulic cylinder;

a height adjustment valve having an inlet side connected to a water supply and an outlet side connected to said water inlet of said hydraulic cylinder and being movable between an operative position wherein water is directed to said hydraulic cylinder to elevate the receptacle to a desired height for use and an inoperative position wherein the flow of water to said hydraulic cylinder is interrupted and the receptacle is maintained at the desired height;

a flush valve having a second inlet side and a second outlet side, said second inlet side communicating with said hydraulic cylinder and said second outlet side communicating with the water inlet end of said receptacle said flush valve being movable between a filling position wherein the hydraulic cylinder fills moving the receptacle to the desired height, and an emptying position wherein the water is drained from said hydraulic cylinder and the receptacle is lowered;

whereby when the height adjustment valve is in the operative position and aid flush valve is in the filling position, water is directed into said hydraulic cylinder and said receptacle is elevated, and when said height adjustment valve is moved to the inoperative position and the flush valve is in the emptying position, water is drained from the hydraulic cylinder and is directed into the water inlet end of said receptacle thereby flushing same.

2. The urinal according to claim 1 further including spring means for automatically retracting said receptacle when said flush valve is in the emptying position.

3. A urinal mounted to a supporting structure for movement from a first storage position to a second in-use position relative to a fixed mounting and comprising:

a receptacle mounted for movement along the supporting structure and including a water inlet end and a waste outlet end below said inlet end;

a hydraulic cylinder including a reciprocable piston for adjusting the height of said receptacle operatively associated with said receptacle, said hydraulic cylinder having one end fixed to the supporting structure and its piston connected for movement to said receptacle, said receptacle being height adjustable and stoppable at any position along the path of travel of said piston;

a height adjustment valve having an inlet side connected to the water supply and an outlet side connected to said water inlet of said hydraulic cylinder and being movable between an operative position wherein water is directed to said hydraulic cylinder to elevate the receptacle to a desired height for use and an inoperative position wherein the flow of water to said hydraulic cylinder is interrupted and the receptacle is maintained at the desired height;

a flush valve having a second inlet side and a second outlet side, said second inlet side communicating with said hydraulic cylinder and said second outlet side communicating with the water inlet end of said receptacle, said flush valve being movable between a filling position wherein said hydraulic cylinder fills elevating said receptacle to a desired height and an emptying position wherein the water is drained from said hydraulic cylinder and the receptacle is lowered;

whereby when the height adjustment valve is in the operative position and said flush valve is in the filling position, water is directed into said hydraulic cylinder and said receptacle is elevated, and when said height adjustment valve is moved to the inoperative position and the flush valve is in the emptying position, water is drained from the hydraulic cylinder and is directed into the water inlet end of said receptacle thereby flushing same.

4. The urinal according to claim 3 further including a spring means having one of its ends mounted to the supporting structure and the other end operatively associated with said receptacle, to urge the receptacle into the inoperative position.

5. The urinal according to claim 4 wherein said spring means has a spring constant that exerts a downward force that is less than the upward force exerted on the receptacle by the hydraulic cylinder when the height adjustment valve is in the operative position for permitting upward movement of said receptacle.

* * * * *